US007226094B2

(12) United States Patent
Swink

(10) Patent No.: US 7,226,094 B2
(45) Date of Patent: Jun. 5, 2007

(54) DOOR LATCH EXTENSION

(76) Inventor: Kerry L. Swink, 2809 SW. 77th, Oklahoma City, OK (US) 73159

( * ) Notice: Subject to any disclaimer, the term of this patent is extended or adjusted under 35 U.S.C. 154(b) by 158 days.

(21) Appl. No.: 11/085,856

(22) Filed: Mar. 22, 2005

(65) Prior Publication Data

US 2006/0214435 A1 Sep. 28, 2006

(51) Int. Cl.
*E05C 17/04* (2006.01)
*E05B 15/02* (2006.01)

(52) U.S. Cl. ..... 292/262; 292/278; 292/285; 292/288; 292/340; 292/DIG. 15; 292/DIG. 19; 16/82; 49/381

(58) Field of Classification Search ..... 292/262, 292/278, 285, 288–298, 300, 304, 340, 341.15, 292/341.17, DIG. 15, DIG. 19; 16/82, 83; 49/381, 383, 460
See application file for complete search history.

(56) References Cited

U.S. PATENT DOCUMENTS 1,532,737 A * 4/1925 Dohrmann ..... 292/278
2,396,982 A * 3/1946 Bousquet ..... 292/289
2,407,900 A * 9/1946 Irving ..... 70/93
3,924,886 A * 12/1975 Markovitch ..... 292/263
4,254,976 A * 3/1981 Shoberg ..... 292/292
4,589,692 A * 5/1986 Boyd ..... 292/297
4,770,451 A * 9/1988 Souza ..... 292/289
5,244,240 A * 9/1993 Nordmeyer et al. ..... 292/263
5,361,539 A * 11/1994 Widener ..... 49/394
5,771,720 A * 6/1998 Levenson ..... 70/93
6,416,089 B1 * 7/2002 Williams, Jr. ..... 292/288
6,520,551 B1 * 2/2003 Crnkovich ..... 292/288
6,976,716 B2 * 12/2005 Lin ..... 292/288

* cited by examiner

*Primary Examiner*—Carlos Lugo
(74) *Attorney, Agent, or Firm*—Dunlap, Codding & Rogers, P.C.

(57) ABSTRACT

A door latch extension is attachable to a doorjamb for maintaining a door in an ajar position. The door latch extension includes a support member, an extension member, and a cover. The support member is mountable to the door jamb by a striker plate portion. The extension member is pivotally connected to the support member. The extension member is provided with a door stop member and a latch cup member. The door stop member is for supporting the door. The latch cup member has a retaining space for a door latch so that the latch cup member cooperates with the door support member to latch the door in the ajar position. The cover is selectively moved in an open position and a closed position. In the closed position, the cover selectively latchingly supports the extension member whereby the door is secured in the ajar position.

14 Claims, 5 Drawing Sheets

DOOR LATCH EXTENSION

CROSS REFERENCE TO RELATED APPLICATIONS

Not applicable.

BACKGROUND OF THE INVENTION

1. Field of the Invention

The present invention relates generally to door latches, and more particularly, not by way of limitation, to an improved door latch extension for maintaining a door in an ajar position and in a closed position.

2. Brief Description of the Prior Art

Structures for maintaining a door ajar are well known in the art. In a typical home, rooms may become colder in winter and hotter in summer due in part to poor air circulation. To counter poor air circulation and to maintain the exclusion of pets and small children from a room, a door structure can be used to maintain a door in an ajar position.

To this end, although door latch structures of the existing art are operable, further improvements are desirable to enhance the use of a door latch extension which functions to selectively maintain a door in an ajar position and in a closed position. It is to such a door latch extension that the present invention is directed.

DETAILED DESCRIPTION OF THE INVENTION

Figure 1:
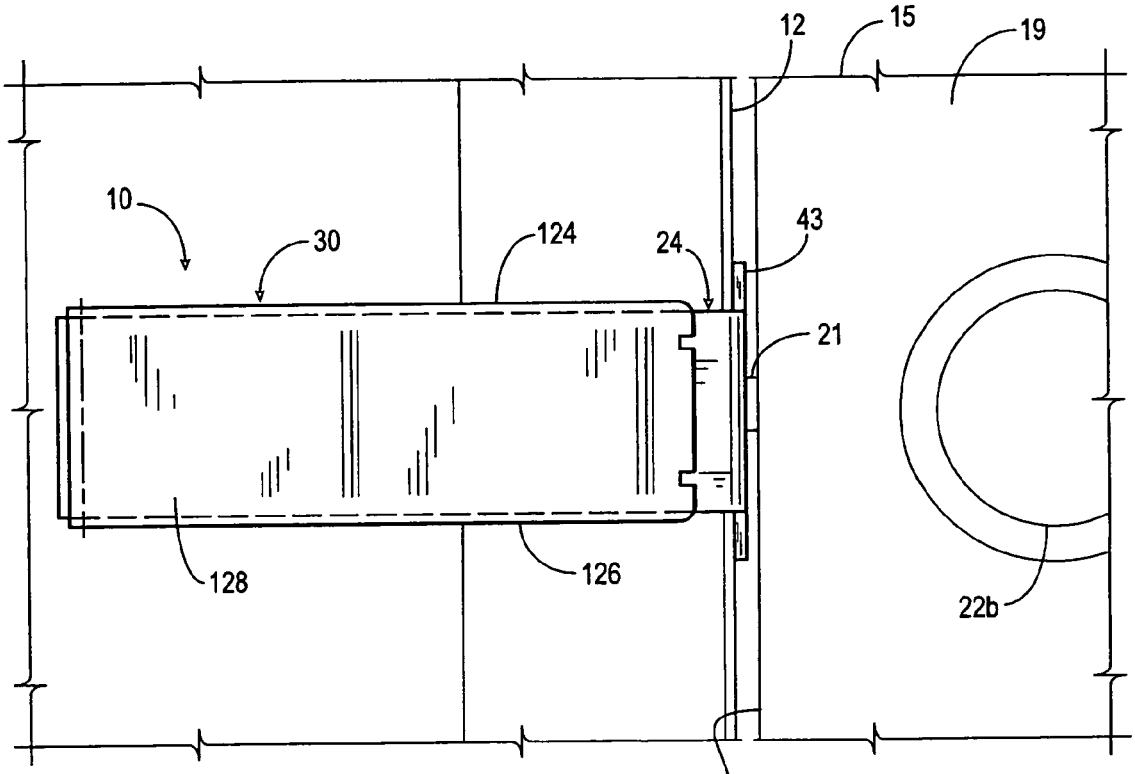
FIG. 1 is an elevational view of a door latch extension constructed in accordance with the present invention, the door latch extension being attached to a door jamb.
Figure 3:
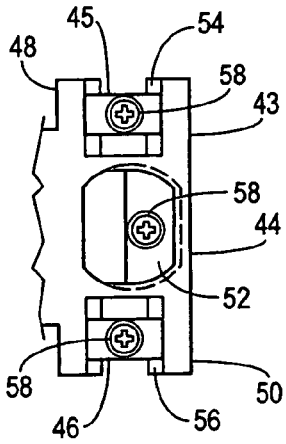
FIG. 3 is an elevational view of a striker plate of the door latch extension of FIG. 1.
Figure 4:
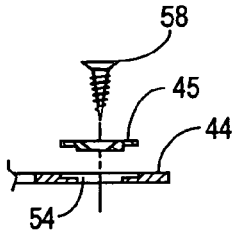
FIG. 4 is an expanded partial cross-sectional elevational view of a portion of the striker plate of FIG. 3.
Figure 2:
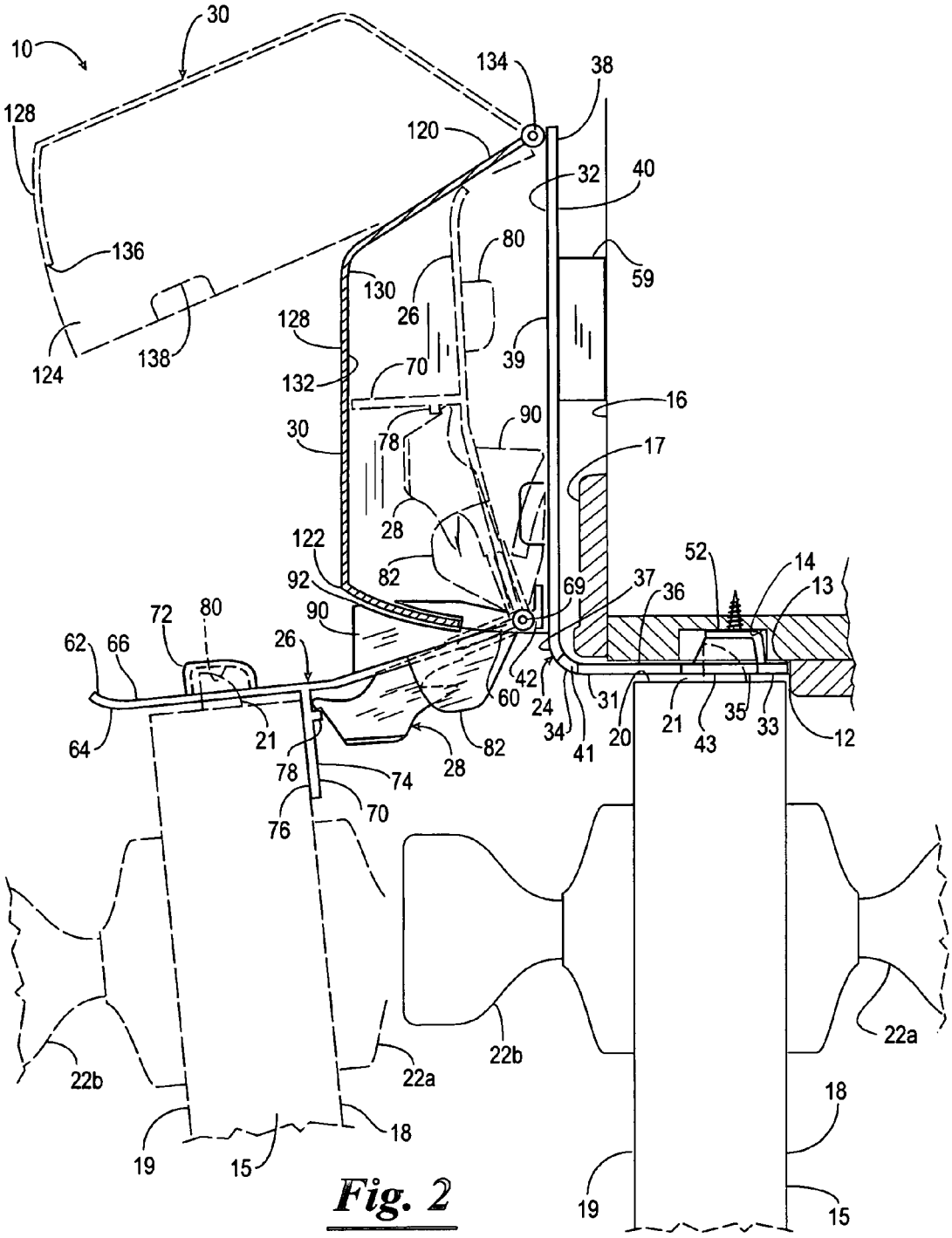
FIG. 2 is a top plan view of the door latch extension of FIG. 1, partially in cross-section wherein the door latch extension is movable between an extended position and a stowed position.

Referring now to the drawings, and more particularly to FIGS. 1 and 2, shown therein is a door latch extension 10 constructed in accordance with the present invention, the door latch extension being shown attached to a door jamb 12. The door jamb 12 includes a front side 13 and a back side 14. A conventional striker plate (not shown) is positioned on the door jamb 12. Preferably, the door jamb 12 is for an interior door 15, rather than an exterior door. However, it should be understood by one of ordinary skill in the art that a door jamb for an exterior door may be utilized with the door latch extension 10 in accordance with the present invention.

The interior door 15, hereinafter referred to also as a door 15, is positioned within a door frame (not shown) having a door trim 17 and the door frame is positioned within an interior wall 16 in a conventional manner. The door 15 includes an exterior side 18, an interior side 19, and a door jamb end 20. The door 15 is provided with a latch 21 connected to the door jamb end 20, a door knob 22*a* on the exterior side 18 and a door knob 22*b* on the interior side 19 of the door 15.

It is contemplated that the door latch extension 10 is constructed from one solid piece of material, however, it should be understood that the door latch extension 10 may be constructed from various components. The door latch extension 10 is preferably made of a durable and rigid material which is strong enough to prevent movement and bending of the door latch extension 10. Suitable materials for construction of the door latch extension 10 and components thereof include metals such as aluminum, steel, titanium, magnesium or alloys containing these metals, plastics, polymeric materials, and composite materials which are capable of providing the desired strength and durability for the door latch extension 10.

As shown in FIG. 2, the door latch extension 10 includes a support member 24, an extension member 26, a locking member 28, and a cover 30. The support member 24 includes a first leg 31 and a second leg 32. The first leg 31 of the support member 24 is substantially perpendicular to the second leg 32 of the support member 24 so that the support member 24 is provided with a substantially L-shaped configuration. However, it should be understood that the support member 24 may be configured in a variety of ways as long as the support member 24 includes the door latch extension 10 to function in accordance with the present invention.

The first leg 31 includes a first end 33, a second end 34, an outer surface 35 and an inner surface 36; and the second leg 32 includes a first end 37, a second end 38, an outer surface 39 and an inner surface 40. The first leg 31 is further provided with an indentation 41 positioned on the outer surface 35 of the first leg 31 so that the indentation 41 is disposed near the first end 37 of the second leg 31. The second leg 32 is provided with a bracket 42 positioned on the outer surface 39 of the second leg 32 near the second end 34 of the first leg 31 for connecting the extension member 26 and the locking member 28 to the support member 24.

Referring to FIGS. 1-4, the first end 33 of the first leg 31 of the support member 24 is provided with a striker plate 43. The first end 33 of the first leg 31 of the support member 24 is mounted to the door jamb 12 by the striker plate 43 by removing the conventional striker plate from the doorjamb 12 and replacing the conventional striker plate with the striker plate 43. Although the striker plate 43 is shown as a unitary portion of the support member 24, it should be understood that the striker plate 43 may be provided as a separate component from the support member 24.

The striker plate 43 includes a body portion 44 and a pair of connector members 45 and 46. The body portion 44 of the striker plate 43 has a first end 48, a second end 50 and a center connector 52 positioned between the first end 48 and the second end 50 of the body portion 44 of the striker plate 43. The center connector 52 is a substantially half-cup-shaped insertion which provides additional support and stability to the striker plate 43 once attached to the doorjamb 12.

Additionally, the body portion 44 includes a pair of channels 54 and 56. The first channel 54 extends from the first end 48 of the body portion 43 toward the center connector 52. The second channel 56 extends from the second end 50 of the body portion 43 toward the center connector 52. The first and second channels 54 and 56, respectively, are configured to matingly receive the connector members 45 and 46, respectively.

Each of the connector members 45 and 46 is provided with a substantially T-shaped configuration. The connector members 45 and 46 are capable of substantially sliding along the channels 54 and 56, respectively, so as to adapt the striker plate 43 to the size of the conventional striker plate. It is well known that there are various sizes of striker plates used in different sized door jambs. The striker plate 43 is capable of adapting to the various conventional sized striker plates by moving the connector members 45 and 46 to the necessary size of the desired connection. A screw 58 is used to connect each of the connector members 45, 46, and the center connector 52 of the striker plate 43 to the door jamb 12. It should be understood that connectors are well known in the art and include various means for connecting one element to another.

The second leg 32 of the support member 24 extends about the door frame so that the inner surface 40 of the second leg 32 of the support member 24 is positioned to prevent coming into contact with the door trim 17. A support pad 59 is applied to the inner surface 40 of the second leg 32 of the support member 24 to allow for a snug fit between the second leg 32 of the support member 24 and the wall 16 when the support member 24 is positioned to extend out from the door trim 17 so that the indentation 41 is positioned above the door trim 17.

Referring to FIGS. 2, 5, and 7-10, the extension member 26 has a first end 60, a second end 62, a first side 64 and a second side 66. The first end 60 of the extension member 26 is pivotally connected to the bracket 42 of the second leg 32 of the support member 24 by any suitable mechanism, such as a pivot pin 69. As more clearly shown in FIG. 2, the extension member 26 is pivotally moved between a first direction and a second direction relative to the second leg 32 of the support member 24 by applying a force to the extension member 26. In the first direction, the extension member 26 is selectively moved into the stowed position. In the second direction, the extension member 26 is selectively moved into the extended position.

As shown in FIG. 2, the extension member 26 is movable between a stowed position and an extended position. By applying a force, the extension member 26 can be selectively moved in a first direction away from the door 15 into the stowed position. In the stowed position, the extension member 26 is positioned so as to be substantially parallel to the second leg 32 of the support member 24. By applying a force, the extension member 26 can be selectively moved in a second direction away from the support member 24 into the extended position.

The extension member 26 further includes a door stop member 70 and a latch cup member 72. The extension member 26 is substantially angled near the door stop member 70 to assist in correct alignment of the door 15 to the extension member 26 when the extension member 26 is in the extended position and to allow for normal door operation when the extension member 26 is in the stowed position which will be discussed in more detail hereinafter. The door stop member 70 extends substantially perpendicular from the extension member 26 and is positioned on the first side 64 of the extension member 26. The door stop member 70 includes a first surface 74 and a second surface 76. The first surface 74 of the door stop member 70 is provided with a fastener 78.

The latch cup member 72 is positioned on the second side 66 of the extension member 26. The latch cup member 72 is provided with a latch retaining space 80 for receiving the latch 21 of the door 15 when the door 15 is moved into the ajar position. The latch retaining space 80 is configured so as to be capable of receiving various sizes of door latches.

Additionally, the extension member 26 is provided with a pair of lugs or fins 82 oppositely disposed from one another on the first side 64 of the extension member 26. The fins 82 are positioned a distance from one another so as to create a retaining space 84. The retaining space 84 is configured to receive the locking member 28. The retaining space 84 provides side support for stowing the locking member 28 and protection from projection 116 of the locking member 28.

Further, the extension member 26 is provided with a locking support member 90. The locking support member 90 is positioned on the second side 66 of the extension member 26. The locking support member 90 is provided with a first portion 91*a* and a second portion 91*b* positioned a distance from one another for providing additional support between the locking support member 90 and the cover 30 when the cover 30 is in a closed position as will be discussed in more detail hereinafter. The locking support member 90 is further provided with a slot 92. The slot 92 of the locking support member 90 cooperates with the cover 30 for providing support to the extension member 26 as will be described in more detail hereinafter.

As shown in FIGS. 2 and 5-10, the locking member 28 is an irregular-shaped member which includes a first end 100, a second end 102, a first side 104 and a second side 106. The first end 100 of the locking member 28 is pivotally connected to the bracket 42 of the second leg 32 of the support member 24 with the pivot pin 69. The locking member 28 is pivotally movable in a first direction and a second direction relative to the support member 24 by applying a force to the locking member 28. The first end 100 of the locking member 28 is provided with a slot 108 enabling the locking member 28 to be slidingly and pivotally moved. The locking member 28 is provided with a fastener 110 which allows the locking member 28 to be moved into a latched position so as to prevent movement of the locking member 28. The second end 102 of the locking member 28 is provided with a projection 112 which cooperates with the fastener 78 of the door stop member 70 to lock the locking member 28 in the latched position against the extension member 26 in any configuration. The first side 104 of the locking member 28 is provided with a door contact cushion 114.

The door contact cushion 114 is positioned near the second end 102 of the locking member 28. The door contact cushion 114 is preferably made from rubber or some other elastomeric material which allows the door contact cushion 114 to come in contact with the door 15 without damaging the door 15. Additionally, the first side 104 of the locking member 28 is provided with a projection 116 positioned near the first end 100 of the locking member 28. The projection 116 is configured to be received by the indentation 41 of the support member 24 when the locking member 28 is moved into a stop position.

Figure 5:
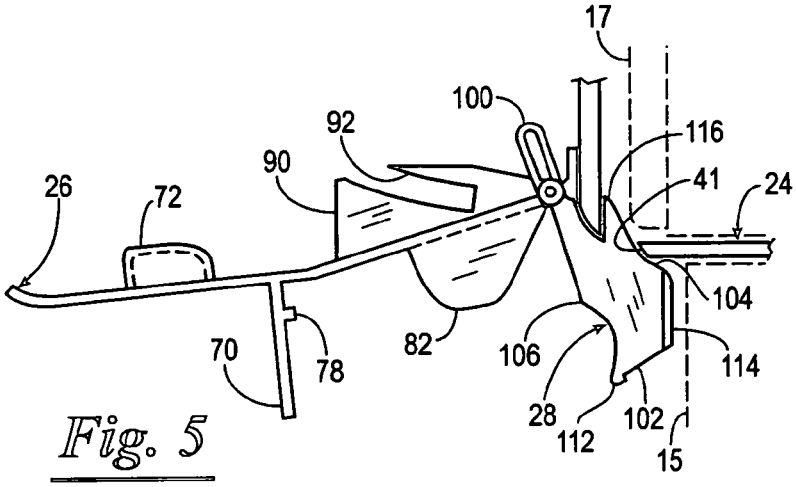
FIG. 5 is a top plan view of a locking member of the door latch extension of the present invention.
Figure 6:
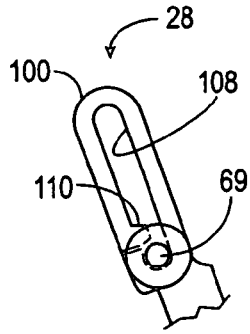
FIG. 6 is a top plan view of a portion of the locking member of FIG. 5.
Figure 7:
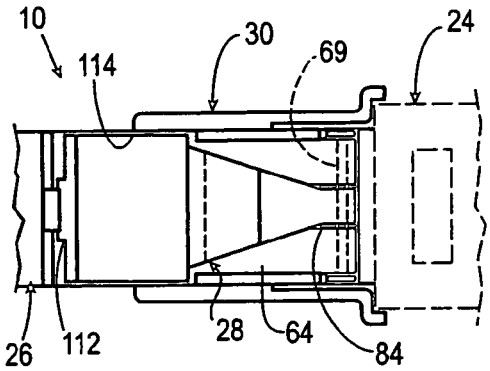
FIG. 7 is an elevational view of the locking member of FIG. 5 in the latched position.
Figure 9:
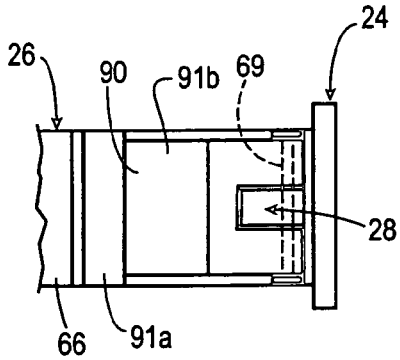
FIG. 9 is an elevational view of a locking support member constructed in accordance with the present invention.
Figure 8:
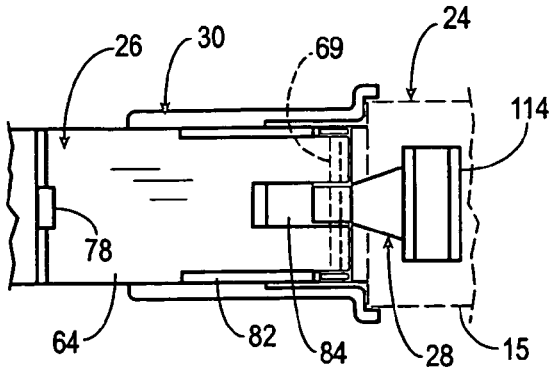
FIG. 8 is an elevational view of the locking member of FIG. 5 in a stop position.

The locking member 28 is movable between a latched position (FIGS. 2 and 7) and the stop position (FIGS. 5 and 8). By applying a force, the locking member 28 can be selectively moved in a first direction away from the support member 24 into the latched position. In the latched position, the locking member 28 is positioned so that the projection 112 of the locking member 28 engages the fastener 78 of the door stop member 70 to lock the locking member 28. By applying a force, the locking member 28 can be selectively moved in a second direction so that the projection 112 of the locking member 28 disengages the fastener 78 of the door stop member 70 and is moved toward the closed door 15. The projection 116 of the locking member 28 is positioned into indentation 41 of the support member 24 so as to place the locking member 28 into a stop position. In the stop position, the locking member 28 is positioned so that the door contact cushion 114 comes substantially in contact with the door 15 thereby preventing the opening of the door 15.

Referring more specifically to FIGS. 1, 2 and 7-10, the cover 30 has a first end 120, a second end 122, a first side 124, a second side 126, an outer surface 128 and an inner surface 130 defining a door latch extension receiving space 132. The first end 120 of the cover 30 is pivotally connected to the second end 38 of the second leg 32 of the support member 24 on the outer surface 39 with a pivot pin 134. The cover 30 is pivotal in the first direction and the second direction relative to the support member 24 by applying a force to the cover 30. A slot 136 is formed in the outer surface 128 of the cover 30 toward the second end 122 of the cover 30. The slot 136 of the cover 30 cooperates with the slot 92 of the locking support member 90 to support the extension member 26 as will be described in more detail hereinafter. A pair of pressure clips wherein one is shown as 138 (the other is not shown), such as provided for child-proof locks, is formed in the first side 124 and in the second side 126 of the cover 30 for locking the cover 30 when in the closed position. However, it should be understood by one of ordinary skill in the art that any various means may be used to lock the cover 30 when in the closed position.

Figure 10:
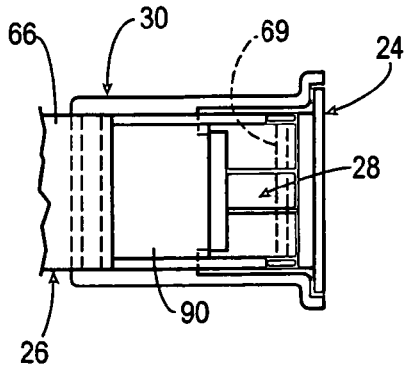
FIG. 10 is an elevational view of the cover in a closed position with the door latch secured in the extended position.

The cover 30 is movable between an open position (FIGS. 2 and 9) and the closed position (FIGS. 2 and 10). By applying a force, the cover 30 can be selectively moved in a first direction away from the support member 24 into the open position. In the open position, the cover 30 is positioned so that extension member 26 may be selectively moved into the extended position. By applying a force, the cover 30 can be selectively moved in a second direction toward the support member 24 into the closed position. In the closed position, the cover 30 is positioned so as to be substantially parallel to the support member 24.

In use, the door latch extension 10 is attached to the doorjamb 12 substantially as shown in FIG. 2. To attach the door latch extension 10 to the door jamb 12, the conventional door striker plate (if present) is removed and replaced with the striker plate 43 of the support member 24. The support pad 59 is positioned on the inner surface 40 of the second leg 38 of the support member 24 allowing for a snug fit of the support member 24 against the wall 16 and so as to prevent contact of the support member 24 with the door trim 17. The extension member 26 is disposed in the stowed position and positioned within the receiving space 132 of the cover 30 since the cover 30 is in the closed position enclosing the extension member 26.

The cover 30 is moved into the open position by simultaneously pressing inwardly on the pressure clips 138 and 140 so as to disengage the cover 30 from the close position. The cover 30 is selectively moved in the first direction and the cover 30 is opened. The door 15 is opened and moved to secure the door 15 in the ajar position. The extension member 26 is moved into the extended position whereby the exterior side 18 of the door 15 comes in direct contact with the second surface 76 of the door stop member 70. The latch 21 of the door 15 is then positioned within the latch retaining space 80. The latch retaining space 80 acts as a striker plate, thus securing the door 15 in the ajar position.

The locking member 28 is maintained in the latched position, so that the fastener 112 of the locking member 28 engages the fastener 78 of the door stop member 70. The cover 30 is moved into the closed position so that the slot 136 of the cover 30 matingly engages the slot 92 of the locking support member 90 which provides stabilizing support to the extension member 26 in the extended position. The door 15 is maintained in the ajar position.

With the extension member 26 extended and locked in place, the door 15 will fit snug when latched into the extension member 26 and the latch support 24 will be adjacently secured against the doorjamb 12 and the wall 16. The door 15 may be opened or closed the way the door 15 normally operates. This economical and easily installed door latch extension 10 will leave the door 15 ajar allowing better air circulation for the room, while preventing animals or small children to transit through the door way. Another advantage of the door latch extension 10 also allows children to be better heard when confined to a room than with the door completely closed and can prevent animals from contact with small children when desired.

Additionally, in use, when the door 15 is completely closed against the door frame, the door latch extension 10 may be utilized as a door stop for denying entrance into a room. When employing the door latch extension 10 as a door stop, the locking member 28 is moved into the stop position. In the stop position, the door contact cushion 114 substantially engages the interior side 19 of the door 15 to prevent the door 15 from being opened. This locking feature or normal operation of the latch 21 cannot be deployed by small children.

When not in use, the extension member 26 is moved into the stowed position wherein the extension member 26 is substantially parallel with the support member 24. The cover 30 is moved into the closed position enclosing the extension member 26 and the locking member 28. The door latch extension 10 is easily stowed to allow for the door 15 to function normally. The door latch extension 10 can be easily installed to replace the common door striker plate on both right hand and left hand doors. It can also be stored out of the way when not in use, maintaining a normal door configuration. At all times the door knob 22 will function normally.

Figure 11:
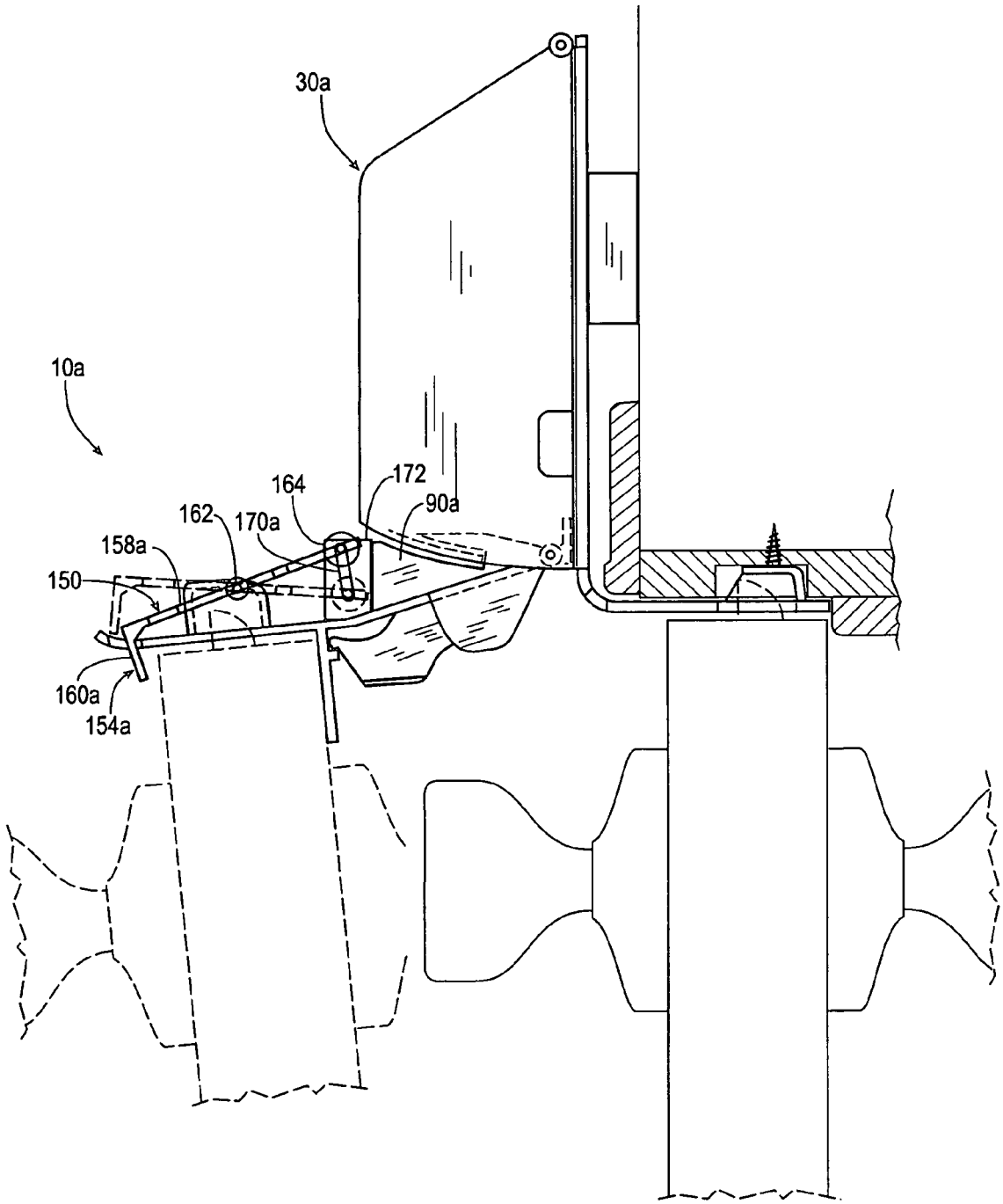
FIG. 11 is a top view of another embodiment of a door latch extension constructed in accordance with the present invention, the door latch extension being attached to a door jamb.
Figure 12:
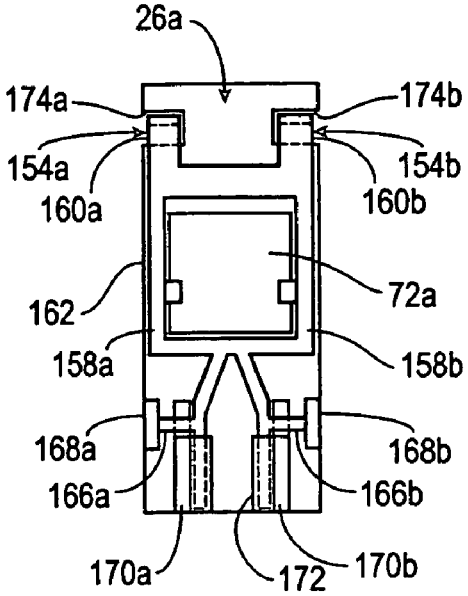
FIG. 12 is an elevational view of a latch support member of the door latch extension of FIG. 11 shown in a latched position.
Figure 13:
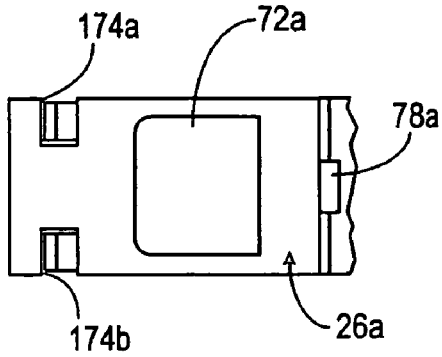
FIG. 13 is an elevational view of the extension member of the door latch extension of FIG. 11.

Referring now to FIGS. 11-13, another embodiment of a door latch extension 10*a* is shown. The door extension 10*a* is similar in construction and function to the door latch extension 10 except that the door latch extension 10*a* is provided with a latch support member 150. The latch support member 150 includes a pair of spatially disposed locking members 154*a* and 154*b*. It should be understood that a single locking member or a plurality of locking members may be utilized so long as the locking member functions according to the present invention. Each of the locking members 154*a* and 154*b* is provided with a first leg 158*a* and 158*b*, respectively, and a substantially normally disposed second leg 160*a* and 160*b*, respectively. Each of the first legs 158*a* and 158*b* is pivotally connected to a latch cup member 72*a* at a medial portion 162 thereof. At a distal end 164 thereof, the first leg 158*a* of the latch support member 150 is connected to a T-shaped member 166*a*, and the first leg 158*b* of the latch support member 150 is connected to a T-shaped member 166*b*. The T-shaped member 166*a* has a head 168*a* and the T-shaped member 166*b* has a head 168*b* such that upon pivotal movement of each of the first legs 158*a* and 158*b*, the T-shaped members 166*a* and 166*b*, respectively, are allowed to travel along an elongated slot 170*a* and 170*b*, respectively, provided in a latch extension 172. The latch extension 172 is connected to a locking support member 90*a* provided on an extension member 26*a*. Preferably, the latch extension 172 and the locking support member 90*a* are constructed of a unitary piece of material, however, it should be understood that the latch extension 172 may be provided as a separate component from the locking support member 90*a*. Each of the first legs 158*a* and 158*b* is a resilient member such that upon opposing pressures to the two first legs 158*a* and 158*b*, the two first legs 158*a* and 158*b* are caused to move inwardly toward each other so as to permit each of the locking members 154*a* and 154*b* to be positioned in a slot 174*a* and 174*b*, respectively, provided in the extension member 26*a* so as to provide additional support whereby the door is secured in the ajar position.

From the above description, it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and claimed.

What is claimed is:

1. A door latch extension attachable to a door jamb, maintaining a door in an ajar position, the door latch extension comprising:

a support member having a striker plate portion, the support member mountable to the door jamb by the striker plate portion;

an extension member pivotally connected to the support member such that the extension member extends from the support member, the extension member having a door stop member and a latch cup member, the door stop member disposed substantially perpendicular to the extension member so as to provide a support for the door, the latch cup member provides a retaining space for a door latch so that the latch cup member cooperates with the door support member to latch the door in the ajar position; and a cover pivotally connected to the support member, the cover being selectively moved in an open position and a closed position such that in the closed position the cover selectively latchingly supports the extension member whereby the door is secured in the ajar position.

2. The door latch extension of claim 1 wherein the striker plate portion comprises a body portion and a pair of connectors wherein the body portion is provided with a center connector such that the center connector and the pair of connectors cooperate to connect the striker plate portion of the support member to the door jamb.

3. The door latch extension of claim 1 wherein the door stop member of the extension member is provided with a fastener.

4. The door latch extension of claim 3 wherein the door latch extension further comprises a locking member provided with a fastener such that the fastener of the locking member engages the fastener of the door stop member so as to selectively latch the locking member whereby the locking member is positioned so as not to hinder movement of the extension member.

5. The door latch extension of claim 1 wherein the door latch extension further comprises a locking support member positioned opposite the door stop member such that the locking support member cooperates with the cover to latchingly support the extension member.

6. The door latch extension of claim 1 wherein the door latch further comprises a latch support member having a plurality of spatially disposed locking members pivotally connected on a portion of the extension member wherein the plurality of spatially disposed locking members is selectively moved to engage a portion of the extension member so as to provide support whereby the door is secured in the ajar position.

7. The door latch extension of claim 1 further having the function of maintaining the door in a closed position wherein a door contact cushion is disposed on the locking member wherein the locking member is selectively moved so that the door contact cushion is positioned against the door whereby the door is maintained in the closed position.

8. A method for maintaining a door in one of an ajar and a closed position, comprising the steps of:

providing a door latch extension, comprising:

a support member having a striker plate portion, the support member mountable to the door jamb by the striker plate portion;

an extension member pivotally connected to the support member such that the extension member extends from the support member, the extension member having a door stop member and a latch cup member, the door stop member disposed substantially perpendicular to the extension member so as to provide a support for the door, the latch cup member provides a retaining space for a door latch so that the latch cup member cooperates with the door support member to latch the door in the ajar position; and a cover pivotally connected to the support member, the cover being selectively moved in an open position and a closed position such that in the closed position the cover selectively latchingly supports the extension member whereby the door is secured in the ajar position;

installing the support member to the doorjamb by the striker plate portion;

extending the extension member attached to the support member from the support member so as to provide a support surface for the door in the ajar position;

selectively moving the door into the ajar position so that the door is supported on the door stop member;

positioning the door latch in the retaining space of the latch cup member so that the latch cup member cooperates with the door stop member to latch the door in the ajar position; and selectively moving the cover in the closed position so that the cover selectively latchingly supports the extension member whereby the door is secured in the ajar position.

9. The method of claim 8 wherein the striker plate portion comprises a body portion and a pair of connectors wherein the body portion is provided with a center connector such that the center connector and the pair of connectors cooperate to connect the striker plate portion of the support member to the door jamb.

10. The method of claim 8 wherein the door stop member of the extension member is provided with a fastener.

11. The method of claim 10 wherein the door latch extension further comprises a locking member provided with a fastener such that the fastener of the locking member engages the fastener of the door stop member so as to selectively latch the locking member whereby the locking member is positioned so as not to hinder movement of the extension member.

12. The method of claim 11 further comprising the steps of:

providing the locking member with a door contact cushion; and selectively moving the locking member so that the door contact cushion is positioned against the door whereby the door is maintained in the closed position.

13. The method of claim 8 wherein the door latch extension further comprises a locking support member positioned opposite the door stop member such that the locking support member cooperates with the cover to latchingly support the extension member.

14. The method of claim 8 wherein the door latch further comprises a latch support member having a plurality of spatially disposed locking members pivotally connected on a portion of the extension member wherein the plurality of spatially disposed locking members is selectively moved to engage a portion of the extension member so as to provide support whereby the door is secured in the ajar position.

* * * * *